United States Patent [19]

Onosato et al.

[11] Patent Number: 4,819,708

[45] Date of Patent: Apr. 11, 1989

[54] MANUALLY OPERABLE ELECTRIC CURTAIN

[75] Inventors: Hiroshi Onosato; Hiroshi Horikoshi; Masahiro Hirahara, all of Tokyo, Japan

[73] Assignee: Toso Kabushiki Kaisha (Toso Company Limited), Tokyo, Japan

[21] Appl. No.: 169,575

[22] Filed: Mar. 17, 1988

[30] Foreign Application Priority Data

Mar. 17, 1987 [JP] Japan ..... 62-060010

[51] Int. Cl.[4] ..... A47H 5/00

[52] U.S. Cl. ..... 160/331; 74/626

[58] Field of Search ..... 160/331, 900, 168.1; 49/139, 140; 74/626

[56] References Cited

U.S. PATENT DOCUMENTS

| | | | |
|---|---|---|---|
| 2,621,542 | 9/1949 | Rath | 49/140 X |
| 3,136,358 | 7/1963 | Madsen | 160/331 |
| 3,561,520 | 2/1971 | Gill | 160/331 |
| 3,672,425 | 6/1972 | Schulze-Robbecke et al. | 160/331 |
| 4,031,944 | 6/1977 | Morrison et al. | 160/331 |
| 4,392,392 | 7/1983 | Perisic et al. | 74/626 |
| 4,437,506 | 3/1984 | Ogita | 160/331 |
| 4,573,723 | 3/1986 | Morita et al. | 74/626 |

FOREIGN PATENT DOCUMENTS

| | | | |
|---|---|---|---|
| 3139073 | 4/1983 | Fed. Rep. of Germany | 160/168.1 |

*Primary Examiner*—Ramon S. Britts
*Assistant Examiner*—David G. Kolman
*Attorney, Agent, or Firm*—Birch, Stewart, Kolasch, & Birch

[57] ABSTRACT

A manually and automatically operable curtain is provided with an electric motor, a planetary gearing of which the sun gear is fixed to the output shaft of the motor, a driven gear engageable with the planet gear of the planetary gearing, a cord pulley fixed to the driven gear for drawing the curtain, and an electric control system including a motor-reversing device. The rotation of the motor is transmitted to the cord pulley through the intermediary of the planet gear when the motor turns. Responsive to a signal to stop the motor, the motor-reversing device reverses the motor for a very small time so as to disengage the planet gear from the driven gear. Thus, the curtain is easily operated by hand without receiving the rotational resistance of the motor.

3 Claims, 3 Drawing Sheets

MANUALLY OPERABLE ELECTRIC CURTAIN

BACKGROUND OF THE INVENTION

The present invention relates to a laterally drawn blind such as a curtain assembly and a folding partition, and more particularly, to a curtain which is automatically actuated by an electric motor and easily drawn by hand while the motor is not activated.

It is known that an electric curtain assembly is provided with an electromagnetic clutch between an electric motor and a cord pulley. The electromagnetic clutch joins the cord pulley with the motor when an open or close switch is pushed to rotate the motor in a manner that the cord pulley pulls a cord to open or close the curtain cloth. The electromagnetic clutch disjoins the cord pulley from the motor when a stop switch or limit switch is activated, so that the curtain is easily opened or closed by hand without receiving the frictional resistance of the motor.

However, the known curtain assembly is not largely used. One reason is that the electromagnetic clutch inconveniently requires periodic maintenance. It is not easy for most families to inspect and maintain the electromagnetic clutch in the curtain assembly. Furthermore, extra energy is consumed to energize the electromagnetic clutch while the motor runs. Another disadvantage is that the known curtain assembly is somewhat expensive due to the electromagnetic clutch.

SUMMARY OF THE INVENTION

The primary object of the invention, therefore, is to provide a manually and automatically operable electric curtain of the type having no electromagnetic clutch.

Another object of the invention is to provide a manually and automatically operable electric curtain that requires no periodic maintenance.

Still another object of the invention is to produce a manually and automatically operable electric curtain at low cost.

A further object of the invention is to provide a manually and automatically operable electric curtain by which no extra electric energy is consumed.

These objects are achieved in the present invention by the use of an electric circuit having a motor-reversing means and planetary gearing between a motor and a cord pulley and an electric circuit for operating the motor. The gearing comprises a sun gear fixed to the output axis of the motor, an arm rotatably fitted on the output axis, a planet gear rotatably mounted on the arm to engage the sun gear, a driven gear fixed to the cord pulley for selective, engagement with the planet gear. The cord pulley is hung by a curtain cord to to draw a curtain cloth. It is arranged that the rotational resistance of the planet gear around its own axis is larger than the rotational resistance of the arm around the sun gear or the output axis of the motor. This means that the planet gear is more easily rotatable around the output axis than around its own axis. The electric circuit comprises main and auxiliary motor-driving circuits and open, close and stop switches. The electric circuit may have either or both limit switches, if necessary.

When the open or close switch is activated, the main motor-driving circuit rotates the motor in either of the rotational directions. As the motor rotates, the planet gear turns together with the arm round the output axis of the motor until it engages the driven gear to prohibit the rotation of the arm. Then, the planet gear rotates around its own axis and transmits the rotation of the sun gear or the motor to the driven gear. The driven gear or the cord pulley draws the curtain cord to open or close the curtain.

Meanwhile, once a stop switch or limit switch is activated, the main motor-driving circuit interrupts the supply of electric current. But, in response to a signal to stop the motor, the auxiliary motor-driving circuit supplies an inverse electric current to the motor for a predetermined short time, so that the motor is instantly reversed before it stops. When the motor reverses, the planet gear is caused to disengage from the driven gear and let the driven gear be free from the motor during the stoppage of the motor. Thus, the curtain is easily drawn by hand without receiving the rotational resistance of the motor.

One important feature of the present invention is that the cord pulley is separated from the motor not by an electromagnetic clutch but by the planetary gearing, which is more inexpensive than the electromagnetic clutch. The electric circuit has main and auxiliary motor-driving circuits of which the elements are very inexpensive and are already available on the market. The planetary gearing is simple and needs no periodical maintenance. Besides, the electric curtain consumes no extra electric energy to energize and heat the electromagnetic clutch.

The foregoing and other objects and advantages of the present invention will be better understood by reference to the following disclosure and drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
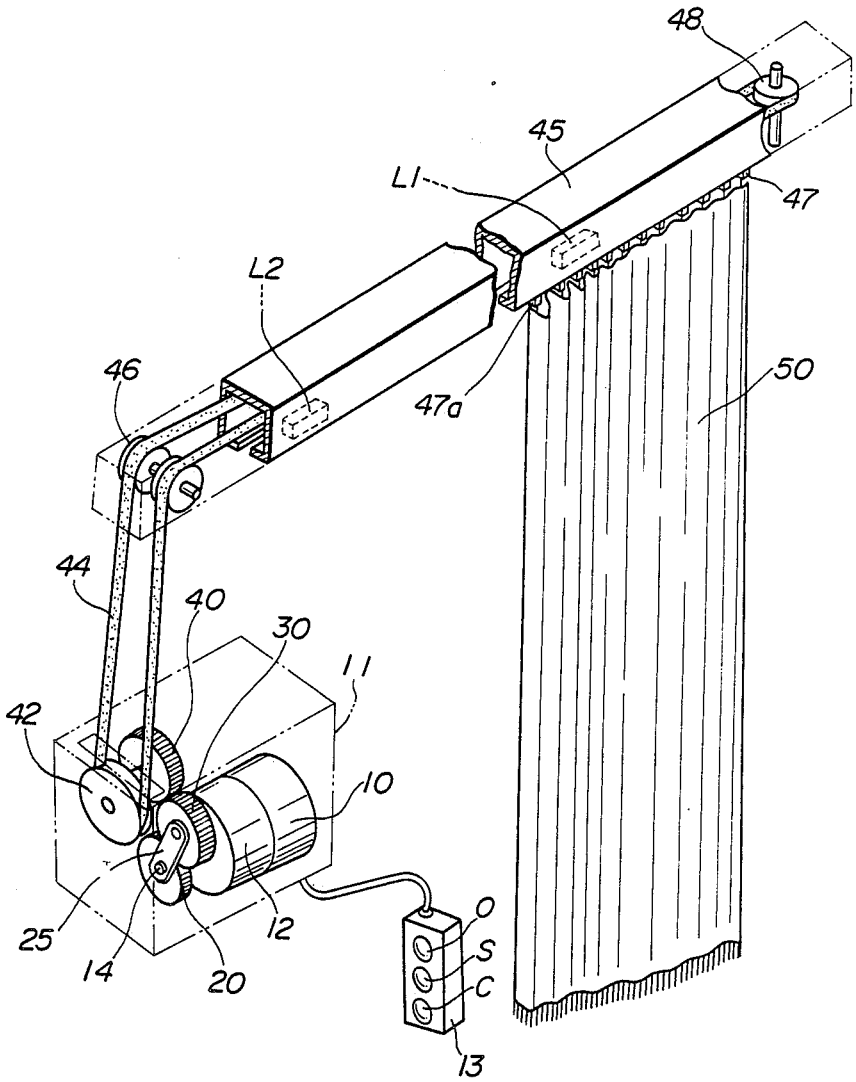
FIG. 1 is a perspective, partly broken view of the relevant portion of the curtain assembly according to the present invention.

As seen in FIG. 1, an electric motor 1 is equipped with a reduction gearing 12. A sun gear 20 is fixed to the output axis 14 of the motor 10. The motor 10 is mounted in the box 11, which is fixed to the curtain rail or other fixed portion. An arm 25 is rotatably fitted on the output axis 14. A planet gear 30 is rotatably mounted on the arm 25 and engaged with the sun gear 20. A cord pulley 42 is rotatably mounted on the box 11 above the motor 10. A driven gear 40 is coaxially fixed to the cord pulley 42. The axes of the driven gear 40 and the sun gear 20 are in a common vertical plane. The half distance between the axes of the sun gear 20 and the driven gear 40 is less than the distance between the axes of the sun gear 20 and the planet gear 30, so that the planet gear 30 engages the driven gear 40 on one side when the sun gear 20 rotates in one direction and on the other side when the sun gear 20 rotates in the other direction.

A curtain cord 44 loops through a pair of vertical guide pulleys 46 provided on one end of a curtain rail 45 between the cord pulley 42 and a horizontal tension pulley 48 mounted on the other end of the rail. A multiplicity of runners 47 are movably mounted in the rail 45 to suspend a curtain cloth 50. The leading runner 47*a* is attached to the cord 44, so that the curtain cloth is opened when the cord 44 is drawn in one direction and closed when the cord 44 is drawn in the other direction. A switch box 13 is provided with open, close, and stop button switches 0, C, and S.

Figure 5:
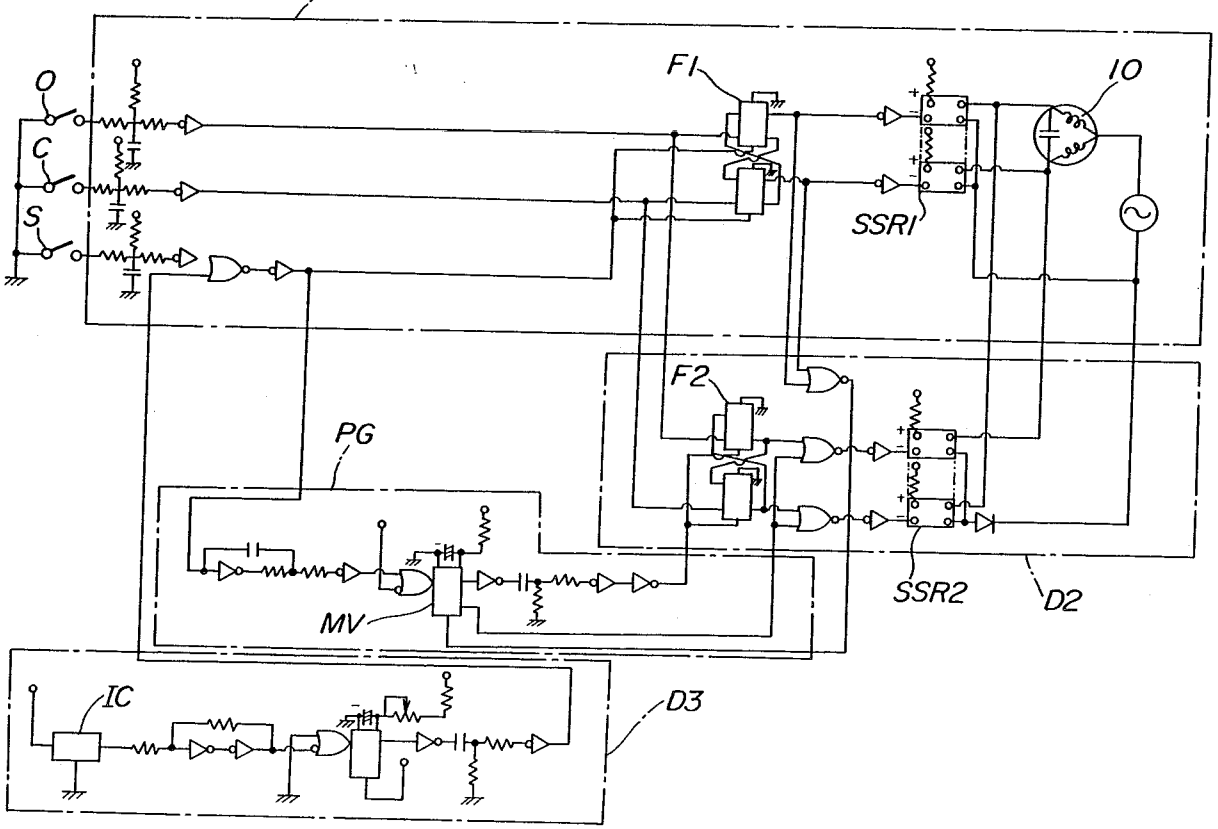
FIG. 5 is a schematic diagram of an electric circuit utilized with the curtain assembly of FIG. 1.

As seen in FIG. 5, the electric circuit has a main motor-driving circuit D1, an auxiliary motor-driving circuit D2, a pulse-generating circuit PG, a detecting circuit D3, and open, close and stop button switches O, C, and S. When the open switch O is activated, the main motor-driving circuit D1 supplies an electric current to the capacitor motor 10 in a manner that the motor rotates in one direction in which the curtain is opened. When the close switch C is activated, the main motor-driving circuit D1 rotates the motor in the other direction in which the curtain is closed. When the stop switch S is activated, the main motor-driving circuit D1 interrupts the supply of electric current. On the other hand, when the stop button switch is pushed, the pulse-generating circuit PG is activated to output pulses to the auxiliary motor-driving circuit D2 for a short time, which can be predetermined by a capacitor built in the pulse-generating circuit. While the auxiliary motor-driving circuit D2 receives the pulses from the pulse-generating circuit PG, it supplies an inverse electric current to the motor 10 in a manner that the motor is instantly rotated in the direction opposite to the previous direction in which the motor has been rotated by the main motor-driving circuit.

Figures 2, 3, 4:
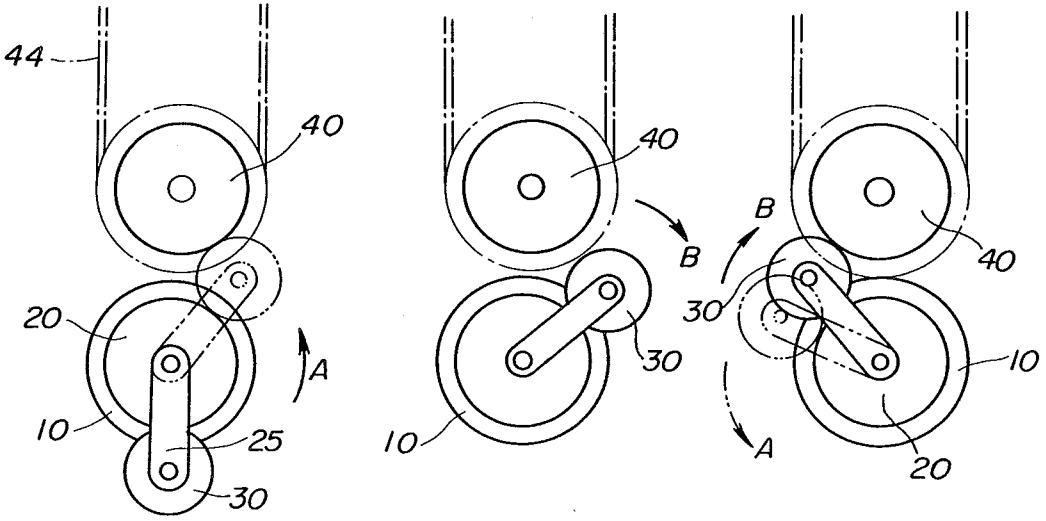
FIG. 2 is a front view of the gearing transmission of FIG. 1, illustrating the planet gear to engage the driven gear on one side thereof when an open switch is activated.
FIG. 3 is a view similar to FIG. 2, illustrating the planet gear disengaged from the driven gear when a stop switch is activated.
FIG. 4 is a view similar to FIG. 2, illustrating the planet gear to engage the driven gear on the other side when a close switch is activated.

As seen in FIG. 2, when the open switch is pushed, the motor 10 rotates with the sun gear 20. The frictional resistance against the rotation of the arm 25 is less than that against the rotation of the planet gear 30 about its own axis, so that the planet gear 30 is prevented from rotating about its own axis but allowed to turn about the sun gear 20 together with the arm 25, as indicated by the arrow A. When the, planet gear 30 is moved to a position illustrated by dotted lines, it engages the driven gear 40 and limits the rotation of the arm 25. Then, the planet gear 30 starts to rotate about its own axis and causes the driven gear 40 to rotate, so that the cord 44 runs to open the curtain cloth. Thereafter, the stop button switch is pushed before or when the curtain cloth is full opened.

As seen in FIG. 3, when the stop button switch is pushed, the auxiliary motor-driving circuit rotates the motor 10 in the direction indicated by the arrow B for an instant, resulting in the planet gear 30 being disengaged from the driven gear 40.

As seen in FIG. 4, when the close button switch is pushed, the motor 10 rotates the planet gear 30 around the sun gear 20 in the direction indicated by the arrow B to engage the driven gear 40, so that the driven gear 40 rotates in the direction opposite to the previous direction when the open switch is pushed. Then, the curtain cloth starts to close. When the stop button switch is pushed before or when the curtain cloth is fully closed, the motor can not stop without rotating in the direction indicated by the arrow A for a very short time. This results in the planet gear 30 being disengaged from the driven gear 40 as illustrated by the dotted line of FIG. 4. While the motor 10 stops, the rotational transmission between the motor 10 and the driven gear 40 is always interrupted with the result that the driven gear 40 is easily rotatable by hand to close or open the curtain cloth.

The electric circuit as illustrated in FIG. 5 allows the motor 10 to rotate in reverse for an instant immediately before it stops. The motor 10 is arranged to stop whenever it receives a resistance beyond a predetermined torque. This permits elimination of open and close limit switches, because the motor 10 automatically stops when the curtain is fully opened, fully closed or accidentally prevented from moving. The stoppage of the motor 10 is detected by a detecting circuit D3 using a hall device IC as a sensing element. The motor 10 of a capacitor type is operated by the main circuit D1 for an ordinary time from when the open button switch 0 or close button switch C is pushed to when the stop button switch S or the detecting circuit is actuated and by the auxiliary circuit D2 for a predetermined short time since the stop button switch S or the detecting circuit D3 is activated. The main circuit D1 includes a pair of flip-flop elements F1 to memorize each operation of the open switch O and the close switch C and a solid state relay element SSR1, which supplies current to the motor 10 in a manner that the motor 10 rotates in the direction in which the curtain is opened when the open switch O is activated and in the opposite direction in which the curtain is closed when the close switch C is activated. When the stop switch S is pushed or the detecting circuit D3 detects the stoppage of the motor 10, the flip-flop element F1 is reset to stop the motor 10. The auxiliary circuit is also provided with another pair of flip-flop elements F2 to memorize each activation of the open and close switches O and C and another solid state relay SSR2 to rotate the motor 10 in the opposite direction. The solid state relay SSR2 in the auxiliary circuit D2 is active only while a pulse-generating circuit PG is producing pulses. The pulse-generating circuit includes one-shot multi-vibrator MV, which generates and transmits pulses to the auxiliary circuit D2 for a predetermined small period in which the solid state relay SSR2 is activated.

The electric circuit of FIG. 5, requiring no mechanical means nor limit switch, makes the motor 10 instantly reverse the rotational direction thereof prior to being stopped, so that the engagement between the planet gear 30 and the driven gear 40 is taken off as seen in FIG. 3. Therefore, the curtain cloth is easily opened or closed by hand while the motor stops. If another type of motor were used, the open and close limit switches L1 and L2 would be provided as illustrated by dotted lines in FIG. 1. The limit switch would be actuated in the same way as the stop switch.

The inventive device is not limited to the curtain assembly which is illustrated in the accompanying drawings but is also available for folding doors or the like which are laterally opened or closed.

The planetary gearing, as an transmission between the motor and the cord pulley, is simple, inexpensive, and easy to be maintained in comparison with the conventional electromagnetic clutch. The all electric elements as shown in FIG. 5 are also inexpensive and already available on the market.

While the preferred embodiment of the invention has been shown and described it should be understood that the present invention should not be limited thereto but that the invention is intended to embrace all embodiments coming within the scope of the appended claims.

What is claimed is:

1. A manually operable electric curtain provided with a curtain rail, a multiplicity of runners movably mounted in said rail, a curtain cloth suspended by said runners, a cord pulley provided on one end or in the vicinity of said curtain rail, a tension pulley provided on the other end or in the vicinity of said curtain rail, a cord looped between said cord pulley and said tension pulley to move along said curtain rail and attached to one of said runners, an electric motor adapted to rotate said cord pulley, open, close and stop switches, a main motor-driving circuit for supplying an electric current to rotate said motor in either direction when said open or close switch is activated and interrupting the current when said stop switch is activated, said curtain comprising a sun gear fixed to the output axis of said motor, an arm rotatably mounted on the output axis of said motor, a planet gear rotatably mounted on said arm to engage said sun gear, a driven gear integrally fixed to said cord pulley and selectively engageable with said planet gear, said arm being arranged to have a less rotational resistance than that of said planet gear, said planet gear being engaged with one side of said driven gear when said open switch is activated and with the other side of said driven gear when said close switch is activated, a pulse-generating circuit for transmitting pulses for a predetermined short time as a result of said stop switch being activated, and an auxiliary motor-driving circuit for supplying an inverse electric current to the current supplied by said main motor-driving circuit while said auxiliary motor-driving circuit is receiving the pulses from said pulse-generating circuit, whereby, when said stop switch is activated, said planet gear disengages from said driven gear and allows said curtain cloth to be easily drawn by hand without receiving the rotational resistance of said motor.

2. The curtain of claim 1, wherein said motor is arranged to stop when it receives a resistance larger than a preselected torque, said pulse-generating circuit comprising a detecting circuit for detecting stoppage of said motor and being arranged to transmit pulses to said auxiliary circuit for a predetermined short time since said detecting circuit is activated by detecting the stoppage of said motor.

3. The curtain of claim 1, wherein said stop switch further comprises open and close limit switches to be respectively activated when said curtain cloth is fully opened and closed.

* * * * *